United States Patent [19]

Amici et al.

[11] Patent Number: 4,917,645

[45] Date of Patent: Apr. 17, 1990

[54] DOLL WITH SOUND GENERATING MECHANISM

[75] Inventors: Francis R. Amici, Northford, Conn.; Brian Fontaine, Southbridge, Mass.; Craig Dubois, Granby, Conn.

[73] Assignee: Hasbro, Inc., Pawtucket, R.I.

[21] Appl. No.: 385,191

[22] Filed: Jul. 26, 1989

[51] Int. Cl.[4] ..... A63H 3/28

[52] U.S. Cl. ..... 446/184; 446/193

[58] Field of Search ..... 446/184, 183, 185, 188, 446/190, 192, 193, 304, 321, 305, 202, 207, 197, 198

[56] References Cited

U.S. PATENT DOCUMENTS

| | | | |
|---|---|---|---|
| 1,243,152 | 10/1917 | Fusch | 446/267 |
| 2,606,399 | 8/1952 | Graham | 446/184 X |
| 2,668,393 | 6/1949 | Rekettye | 446/304 X |
| 2,678,516 | 5/1954 | Graham | 446/184 |
| 2,689,430 | 10/1948 | Freeland | 446/305 X |
| 2,777,252 | 1/1957 | Tancredi et al. | 446/184 |
| 3,229,421 | 1/1966 | Ostrander | 446/304 |
| 3,416,488 | 12/1968 | Merl | 446/193 X |
| 3,514,899 | 6/1970 | Bonanno et al. | 446/304 X |
| 3,729,859 | 5/1973 | Smith, III et al. | 446/267 |
| 3,822,500 | 7/1974 | Ostrander | 446/183 |
| 4,160,338 | 7/1979 | Lyons et al. | 446/305 X |
| 4,194,303 | 3/1980 | Heller | 446/183 X |
| 4,595,379 | 6/1986 | Rasmussen et al. | 446/304 X |

*Primary Examiner*—Mickey Yu

[57] ABSTRACT

A doll is provided with a sound generating mechanism which includes a cavity-defining enclosure in the head, a sound generating bladder in the enclosure, a compressible pillow in the torso, and a conduit extending between the pillow and the bladder. When the pillow is compressed, air passing through the bladder causes it to vibrate and flutter and produce a sound which is amplified in the cavity-defining enclosure. The doll's torso is soft so that pressure applied to the back of the torso will compress the pillow.

19 Claims, 2 Drawing Sheets

DOLL WITH SOUND GENERATING MECHANISM

BACKGROUND OF THE INVENTION

The present invention relates to dolls, and, more particularly, to dolls which will produce sounds simulating those of an infant during feeding.

As it is well known, children playing with dolls prefer those which offer enhanced play action in the form of a "response" to some action which the child is taking with respect to the doll. In some instances, dolls have been provided with the ability to make sounds as the child is manipulating the doll; in other instances, the doll will move a limb or eyes in reaction to the manipulative action of the child. More recently, electronics have been utilized to produce simulated speech, and various motors have also been provided which are actuatable to produce some form of movement in the doll.

One type of doll which has enjoyed considerable popularity over the years is an infant doll which may be utilized in connection with a simulated baby nursing bottle so that the child can simulate the feeding of the infant doll. A number of mechanisms have been proposed to provide a sound effect that would simulate that of the baby being fed or reacting to being fed.

It is an object of the present invention to provide a novel doll structure which will provide sounds upon manipulation by a child.

It is also an object to provide such a doll which relies on simple mechanical components to produce the sound in response to pressure applied by the child to a portion of the doll.

Still another object is to provide such a doll which may be assembled from components which are fabricated readily and relatively economically and which will exhibit long life.

SUMMARY OF THE INVENTION

It has now been found that the foregoing and related objects may be readily attained by providing a doll having a torso, head, arms and legs; with a sound producing mechanism placed within the doll. The mechanism includes a compressible pillow in the torso providing a volume of air therewithin, a closed cavity-defining member in the head, a bladder within the member, and a conduit from the pillow to the bladder. The bladder is expanded and vibrates upon passage of air therethrough from the conduit, and this produces a sound simulating that of an infant burping. The cavity defining member amplifies the sound.

In the preferred embodiment, the bladder is of elongated serpentine configuration and provides a restricted air passage therethrough. Desirably, it is fabricated from a resiliently deformable material.

Desirably, the pillow has valve means therein for admitting air thereinto to compensate for air lost from the mechanism, and this is conveniently a flapper valve. The pillow is adjacent the back of the torso and is compressible by applying pressure to the back of the torso.

Generally the cavity-defining member has a base wall extending transversely of the head and torso, and a support plate depending from the base wall and in the torso, the pillow is mounted on the support plate.

In one embodiment, the conduit extends from the pillow through the support plate and thence through the base wall. In another embodiment, the pillow member is also mounted in part on the base wall and the conduit extends upwardly therefrom through the base wall.

Generally, the head and torso of the doll are joined by engagement of a depending cylindrical neck portion on the head rotatably seated in a circular recess at the upper end of the torso, and the cavity-defining member extends into the neck portion. The base of the cavity-defining member extends across the bottom of the neck portion.

DETAILED DESCRIPTION OF PREFERRED EMBODIMENT OF THE INVENTION

Figure 1:
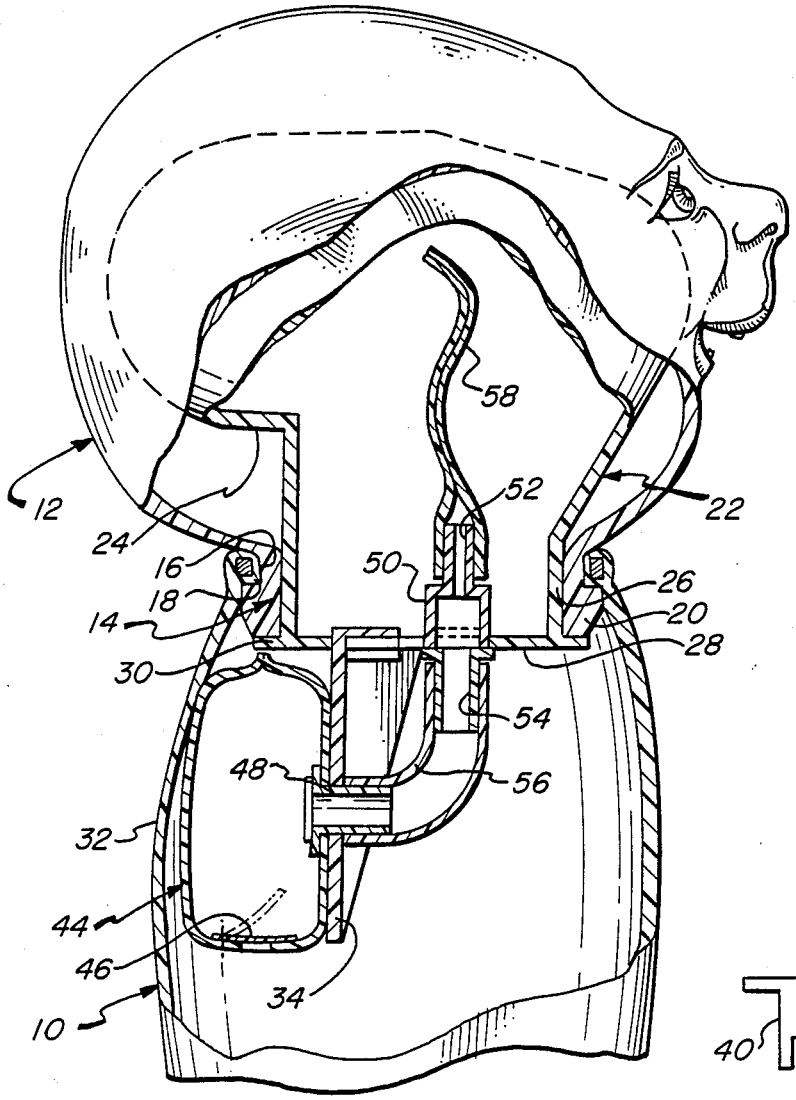
FIG. 1 is a fragmentary side elevational view of a doll embodying the present invention with portions broken away to review internal construction.
Figure 7:
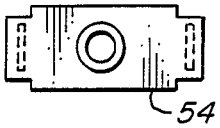
FIG. 7 is a bottom view of the conduit mounting element on the lower surface of the base wall.
Figure 8:
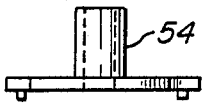
FIG. 8 is an elevational view thereof.
Figure 6:
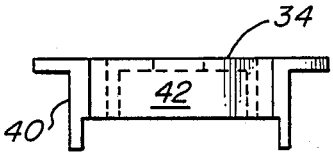
FIG. 6 is a top plan view thereof.
Figure 3:
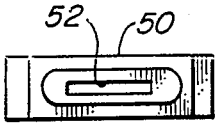
FIG. 3 is a top plan view thereof.
Figure 2:
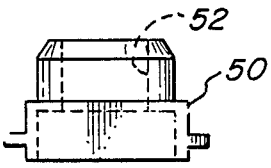
FIG. 2 is a side elevational view of the bladder mounting pedestal.
Figure 4:
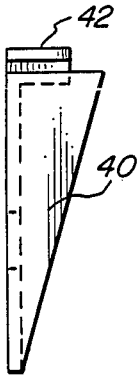
FIG. 4 is a side elevational view of the support plate.
Figure 5:
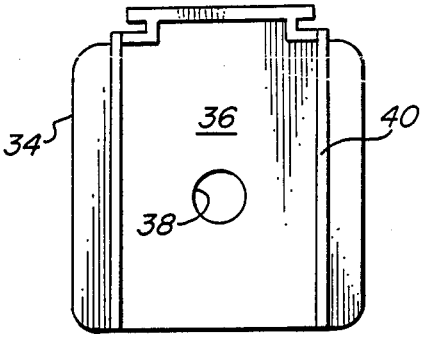
FIG. 5 is a rear view thereof.

A doll embodying the present invention is fragmentarily illustrated in FIG. 1 and has a torso generally designated by the numeral 10 and a head generally designated by the numeral 12. The head has a cylindrical collar or neck portion generally designated by the numeral 14 which extends through a circular aperture 16 at the upper end of the torso 10. As seen, the wall of the torso 10 has an inwardly extending lip 18 which defines the aperture 16, and the neck portion 14 has an outwardly projecting lip 20 which seats under the lip 18 to rotatably lock the head 12 onto the torso 10.

Disposed principally within the head 12 is a closed cavity-defining member or sound box generally designated by the numeral 22 with an enlarged upper portion 24, and a generally cylindrical lower portion 26 which snugly seats within the neck portion 14. At the lower end of the member 22 is a base wall 28 which provides a closure for the member 22 and which has a peripheral flange 30 which extends outwardly against the lower surface of the neck portion 14.

Depending from the base wall 28 adjacent the back 32 of the torso 10 is a support plate 34 which has a transverse wall 36 with an aperture 38 therein and which is stiffened by the tapered side walls 40. Its top wall 42 is sonically welded or otherwise bonded to the base wall 28.

Secured to the transverse wall 36 and extending towards the back 32 of the torso is a compressible pillow generally designated by the numeral 44 and having a flapper valve 46 in the lower end thereof. A flanged nipple 48 extends through the wall of the pillow 44 and the aperture 38 in the transverse wall 36. Secured in an aperture in the base wall 28 of the member 22 are an upstanding elongated mounting pedestal 50 with an air passage 52 therethrough, and a depending nipple 54.

These components are bonded together and to the base wall 28.

A flexible tubular member 56 fits over the nipples 48 and 54, and the several elements together provide an air passage or conduit from the pillow 44 to the interior of the member 22.

Seated on the pedestal 50 is an elongated serpentine bladder 58 which provides a restricted air passage therethrough and generally of the type used in "whoopee" cushions to provide noise.

When the back 32 of the doll is pushed inwardly, the pillow 44 is compressed and air is forced through the nipple 48, tubular member 56, nipple 54 and pedestal 50 and into the bladder 58. As the air is forced therethrough, the walls of the bladder 58 are resiliently deformed and flutter, and the effect is a vibrating sound.

Since there is a large, virtually empty cavity within the member 22, the sound is amplified and the result is an audible low pitched noise simulating the burping of a baby.

Figure 9:
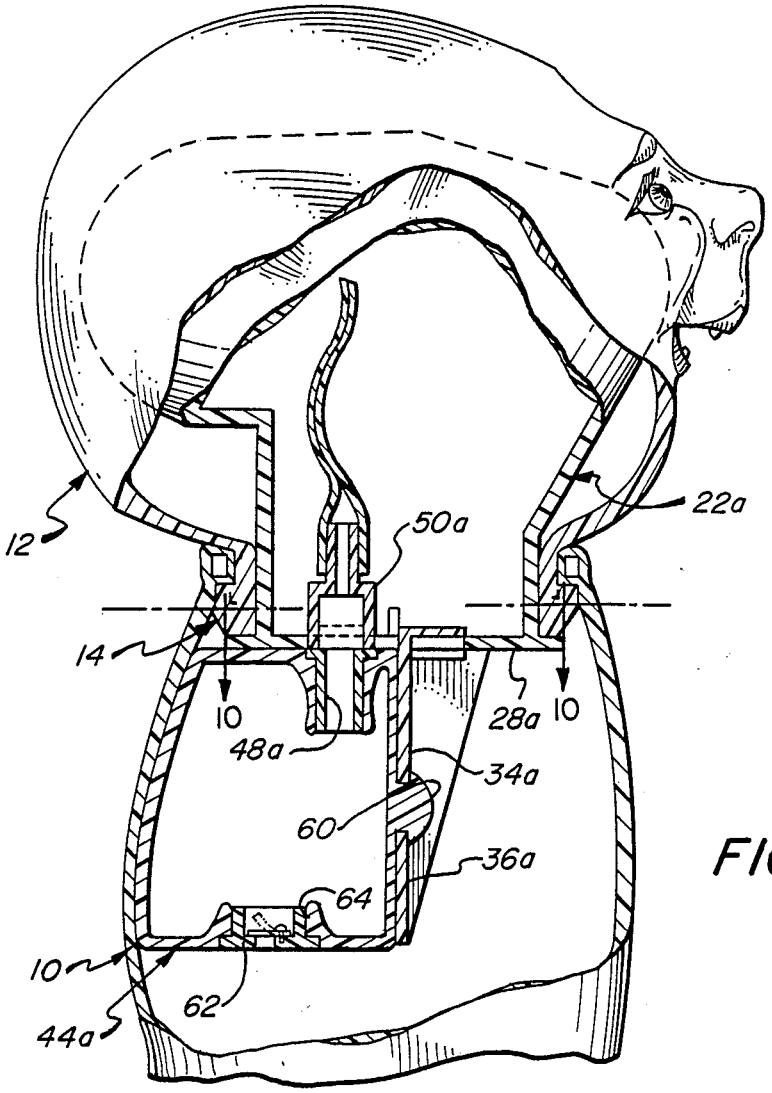
FIG. 9 is a fragmentary side elevational view of another embodiment of doll embodying the present invention with portions broken away to review internal construction.
Figure 10:
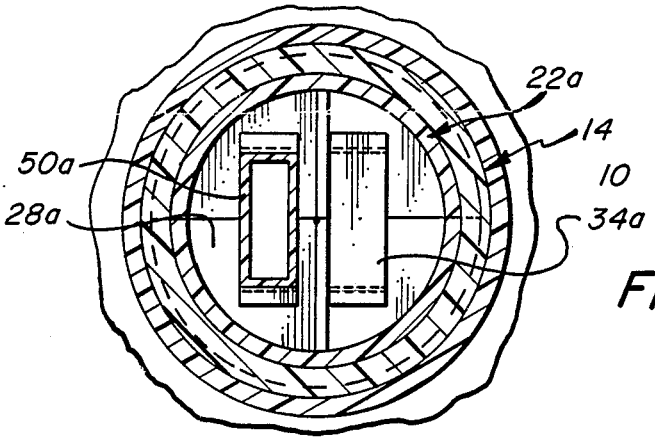
FIG. 10 is a sectional view thereof along the line 10—10 of FIG. 9.

Turning now to FIGS. 9 and 10, the embodiment of the invention illustrated therein is similar with respect to the doll but differs with reppect to the sound producing mechanism. In this embodiment the pedestal **50*a* is disposed on the base wall 28*a* of the member 22*a* above the pillow 44*a*, and the nipple 48*a* extends directly into the pillow 44*a* which is sealed thereabout. The pillow 44*a* is secured on the transverse wall 36*a* of the support plate 34*a* by the mushroom-like boss 60, and is also adhered to the base wall 28*a*. A flapper valve 62 is provided by a separately formed insert seated in a circular, reinforced aperture 64 in the bottom of the pillow 44*a***.

In play, the child simply presses upon the back portion of the doll in the area where the compressible pillow is located, and this causes air to be expelled from the pillow and upwardly through the bladder. As the air passes through the constricted bladder, it produces resilient expansion of the opposing faces of the bladder and fluttering action due to the curvature which is imparted by its serpentine configuration. Because of the constriction and fluttering which is taking place, the sound simulates that of a burp. As indicated previously, this sound is amplified by the relatively hollow chamber within the doll's head to produce a more audible sound externally of the doll.

As is well known in the art, the bladder through which the air is expelled is a long flexible flutter tube fabricated from an elastomeric material such as rubber. The tube has opposed walls which normally lie flat against each other in face to face contact, and they are forced apart to permit the passage of air therethrough.

Although a rectilinear orientation for the bladder will produce sound, providing an elongated serpentine path enhances the flapping or fluttering action of the bladder as the air is passing therethrough and increases and changes the nature of the sound being generated.

The cavity-defining member in the head can assume a variety of configurations, but generally the larger the cavity, the greater the sound which will be produced. Moreover, by combining the cavity defining member with means for carrying the pillow, assembly of the doll is facilitated.

Generally, it is desirable to fabricate the entire skin or shell of the doll from a relatively resiliently deformable material such as a plasticized vinyl chloride or a rubbery polymer. The doll may be hollow, with the exception of the structure which is herein defined, or it may be filled with soft materials such as resin or fiber.

By fabricating the several elements of the internal structure as indicated, the sound producing mechanism may be assembled with the head of the doll, and then the entire assembly inserted into the torso of the doll.

All of the elements may be readily fabricated from relatively economical resins, and the various parts of the sound producing assembly can be bonded together by sonic welding or other means of adhesion.

Thus, it can be seen from the foregoing detailed specification and accompanying drawings that the doll of the present invention is one which will provide an interesting audible sound simulating the burping of an infant as it is being fed, and the action required to achieve that sound is simply pressure applied to the back of the doll's torso. The elements of the structure are readily fabricated and assembled to provide a relatively long lived play toy.

Having thus described the invention, what is claimed is:

1. A sound producing doll comprising:

(a) a doll having a torso, head, arms and legs; and (b) a sound producing mechanism in said doll comprising (i) a compressible pillow in said torso providing a volume of air therewithin, (ii) a closed cavity-defining member in said head and having a base wall extending transversely of said head and torso, said pillow being supported on said base wall, (iii) a bladder within said member, and (iv) a conduit from said pillow to said bladder, said bladder being expansible and vibrating upon passage of air therethrough from said conduit and producing a sound simulating that of an infant burping, the sound being amplified by said cavity-defining member.

2. The sound producing doll in accordance with claim 1 wherein said bladder is of elongated serpentine configuration and provides a restricted air passage therethrough.

3. The sound producing doll in accordance with claim 2 wherein said bladder is fabricated from a resiliently deformable material.

4. The sound producing doll in accordance with claim 1 wherein said pillow has valve means therein for admitting air thereinto to compensate for air lost from said mechanism.

5. The sound producing doll in accordance with claim 4 wherein said valve means is a flapper valve.

6. The sound producing doll in accordance with claim 1 wherein said pillow is adjacent the back wall of said torso and is compressible by applying pressure to the back of said torso.

7. A sound producing doll comprising:

(a) a doll having a torso, head, arms and legs; and (b) a sound producing mechanism in said doll comprising (i) a compressible pillow in said torso providing a volume of air therewithin, (ii) a closed cavity-defining member in said head, (iii) a bladder within said member, and (iv) a conduit from said pillow to said bladder, said bladder being expansible and vibrating upon passage of air therethrough from said conduit and producing a sound simulating that of an infant burping, the sound being amplified by said cavity-defining member, said cavity-defining member having a base wall extending transversely of the head and torso and a support plate depending from said base wall and in said torso, said pillow being mounted on said support plate.

8. The sound producing doll in accordance with claim 7 wherein said conduit extends from said pillow through said support plate and thence through said base wall.

9. The sound producing doll in accordance with claim 7 wherein said pillow member is also mounted in part on said base wall and said conduit extends upwardly therefrom through said base wall.

10. A sound producing doll comprising:

(a) a doll having a torso, head, arms and legs; and (b) a sound producing mechanism in said doll comprising (i) a compressible pillow in said torso providing a volume of air therewithin, (ii) a closed cavity-defining member in said head, (iii) a bladder within said member, and (iv) a conduit from said pillow to said bladder, said bladder being expansible and vibrating upon passage of air therethrough from said conduit and producing a sound simulating that of an infant burping, the sound being amplified by said cavity-defining member, said head and torso being joined by engagement of a depending cylindrical neck portion on said head rotatably seated in a circular recess at the upper end of said torso, and said cavity-defining member extending within said neck portion.

11. The sound producing doll in accordance with claim 10 wherein said cavity-defining member has a base wall extending across the lower end of said neck portion.

12. The sound producing doll in accordance with claim 11 wherein said cavity-defining member has a support plate depending from said base wall in said torso and said pillow is mounted on said support wall.

13. A sound producing doll comprising:

(a) a doll having a torso, head, arms and legs; and (b) a sound producing mechanism in said doll comprising (i) a compressible pillow in said torso providing a volume of air therewithin, (ii) a closed cavity-defining member in said head and having a base wall extending transversely of said head and torso, said pillow being supported on said base wall, (iii) a bladder within said member, and (iv) a conduit from said pillow to said bladder, said bladder being expansible and vibrating upon passage of air therethrough from said conduit and producing a sound simulating that of an infant burping, the sound being amplified by said cavity-defining member.

14. The sound producing doll in accordance with claim 13 wherein said pillow has valve means therein for admitting air thereinto to compensate for air lost from said mechanism.

15. A sound producing doll comprising:

(a) a doll having a torso, head, arm s and legs; and (b) a sound producing mechanism in said doll comprising (i) a compressible pillow in said torso providing a volume of air therewithin, (ii) a closed cavity-defining member in said head, (iii) a bladder within said member, and (iv) a conduit from said pillow to said bladder, said bladder being expansible and vibrating upon passage of air therethrough from said conduit and producing a sound simulating that of an infant burping, the sound being amplified by said cavity-defining member, said cavity-defining member having a base wall extending transversely of the head and torso and a support plate depending from said base wall and in said torso, said pillow being mounted on said support plate.

16. A sound producing doll comprising:

(a) a doll having a torso, head, arms and legs, said head and torso being joined by engagement of a depending cylindrical neck portion on said head rotatably seated in a circular recess at the upper end of said torso; and (b) a sound producing mechanism in said doll comprising (i) a compressible pillow in said torso providing a volume of air therewithin, (ii) a closed cavity-defining member in said head extending within said neck portion and having a base wall extending across the bottom of said neck portion, (iii) a bladder within said member, and (iv) a conduit from said pillow to said bladder, said bladder being of elongated serpentine configuration and providing a restricted air passage therethrough, said bladder being fabricated from a resiliently deformable material, said bladder being expansible and vibrating upon passage of air therethrough from said conduit and producing a sound simulating that of an infant burping, the sound being amplified by said cavity defining member.

17. The sound producing doll in accordance with claim 17 wherein said cavity-defining member has a support plate depending from said base wall in said torso and said pillow is mounted on said support plate.

18. The sound producing doll in accordance with claim 17 wherein said conduit extends from said pillow through said support plate and thence through said base wall.

19. The sound producing doll in accordance with claim 17 wherein said pillow member is also mounted in part on said base wall and said conduit extends upwardly therefrom through said base wall.

* * * * *

UNITED STATES PATENT AND TRADEMARK OFFICE

CERTIFICATE OF CORRECTION

PATENT NO. : 4,917,645

DATED : April 17, 1990

INVENTOR(S) : Francis R. Amici, Brian Fontaine and Craig Dubois

It is certified that error appears in the above-identified patent and that said Letters Patent is hereby corrected as shown below:

Column 6, Line 43, delete "17" and insert --16--.

Signed and Sealed this

Fifth Day of November, 1991

*Attest:*

HARRY F. MANBECK, JR.

*Attesting Officer*

*Commissioner of Patents and Trademarks*